US010061333B1

(12) United States Patent
Liu et al.

(10) Patent No.: US 10,061,333 B1
(45) Date of Patent: Aug. 28, 2018

(54) RADIO FREQUENCY VOLTAGE-TO-CURRENT CONVERTING CIRCUIT AND METHOD

(71) Applicant: Beken Corporation, Shanghai (CN)

(72) Inventors: Jiazhou Liu, Shanghai (CN); Dawei Guo, Shanghai (CN)

(73) Assignee: BEKEN CORPORATION, Shanghai (CN)

( * ) Notice: Subject to any disclaimer, the term of this patent is extended or adjusted under 35 U.S.C. 154(b) by 0 days.

(21) Appl. No.: 15/619,487

(22) Filed: Jun. 11, 2017

(30) Foreign Application Priority Data

May 16, 2017 (CN) ..... 2017 1 0344725

(51) Int. Cl.
*G05F 1/56* (2006.01)

(52) U.S. Cl.
CPC ..... *G05F 1/561* (2013.01)

(58) Field of Classification Search
CPC ..... H03F 3/45179
See application file for complete search history.

(56) References Cited

U.S. PATENT DOCUMENTS 5,513,389 A * 4/1996 Reeser ..... H03F 1/3211 330/268
7,764,124 B2 * 7/2010 Aram ..... H03F 1/26 330/253
2006/0284679 A1 * 12/2006 Roine ..... H03F 3/193 330/253
2011/0163808 A1 * 7/2011 Kumar ..... H03F 3/45179 330/253
2014/0085007 A1 * 3/2014 Hadji-Abdolhamid ..... H03F 3/19 330/297

* cited by examiner

*Primary Examiner* — Thomas J Hiltunen
(74) *Attorney, Agent, or Firm* — Perkins Coie LLP

(57) ABSTRACT

A voltage-to-current converting circuit, comprising: a direct current (DC) bias circuit, a first DC-blocking circuit, a second DC-blocking circuit, a first differential input pair and a second differential input pair; wherein the DC bias circuit is connected to the first and second DC-blocking circuits and configured to provide a bias voltage to the first and the second differential input pairs; wherein the first DC-blocking circuit is connected between the DC bias circuit and the first and second differential input pair and the second DC-blocking circuit is connected between the DC bias circuit and the first and second differential input pair; and wherein the first differential circuit is connected to the second differential circuit via two resistors.

14 Claims, 5 Drawing Sheets

RADIO FREQUENCY VOLTAGE-TO-CURRENT CONVERTING CIRCUIT AND METHOD

CLAIM OF PRIORITY

This application claims priority to Chinese Application No. 201710344725.6, entitled "RADIO FREQUENCY VOLTAGE-TO-CURRENT CONVERTING CIRCUIT AND METHOD," filed on May 16, 2017 by Beken Corporation, which is incorporated herein by reference.

TECHNICAL FIELD

The present application relates to circuits, and more particularly but not exclusively to a radio frequency (RF) voltage-to-current converting circuit and method of converting voltage to current in a radio frequency receiving circuit.

BACKGROUND

In a conventional RF receiving front-end circuit, a voltage-to-current converting circuit is connected between a low noise amplifier (LNA) and a mixer and configured to provide current to drive the mixer. To drive the mixer, the voltage-to-current converting circuit should have a higher linearity. In the prior art, the voltage-to-current converting circuit with high linearity always use larger inductors as source-degeneration at the source end or use more current sources to increase extra currents. However, the circuit comprising larger inductors or current sources raises the product costs or result in the increase of direct current (DC) power consumption.

To solve the above problems, a radio frequency voltage-to-current converting circuit with high linearity and low power consumption and a corresponding method may be necessary.

SUMMARY OF THE INVENTION

In an embodiment, a voltage-to-current converting circuit comprises a direct current (DC) bias circuit, a first DC-blocking circuit, a second DC-blocking circuit, a first differential input pair and a second differential input pair; wherein the DC bias circuit is connected to the first and second DC-blocking circuits and configured to provide a bias voltage to the first and the second differential input pairs; wherein the first DC-blocking circuit is connected between the DC bias circuit and the first and second differential input pairs and the second DC-blocking circuit is connected between the DC bias circuit and the first and second differential input pairs; and wherein the first differential circuit is connected to the second differential circuit via two resistors.

Another embodiment discloses a method for converting voltage to current by a voltage-to-current converting circuit, wherein the circuit comprises a direct current (DC) bias circuit, a first DC-blocking circuit, a second DC-blocking circuit, a first differential input pair and a second differential input pair; wherein the DC bias circuit is connected to the first and second DC-blocking circuits; wherein the first DC-blocking circuit is connected between the DC bias circuit and the first and second differential input pairs and the second DC-blocking circuit is connected between the DC bias circuit and the first and second differential input pairs; and wherein the first differential circuit is connected to the second differential circuit via two resistors; the method comprises: generating, by the DC bias circuit, a bias voltage; blocking, by the first and second DC-blocking circuits, direct current from the DC bias circuit; outputting, by the first and second differential input pairs, differential output voltage; and outputting a current through the two resistors.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION OF THE ILLUSTRATED EMBODIMENTS

Various aspects and examples of the invention will now be described. The following description provides specific details for a thorough understanding and enabling description of these examples. Those skilled in the art will understand, however, that the invention may be practiced without many of these details. Additionally, some well-known structures or functions may not be shown or described in detail, so as to avoid unnecessarily obscuring the relevant description.

Figure 1:
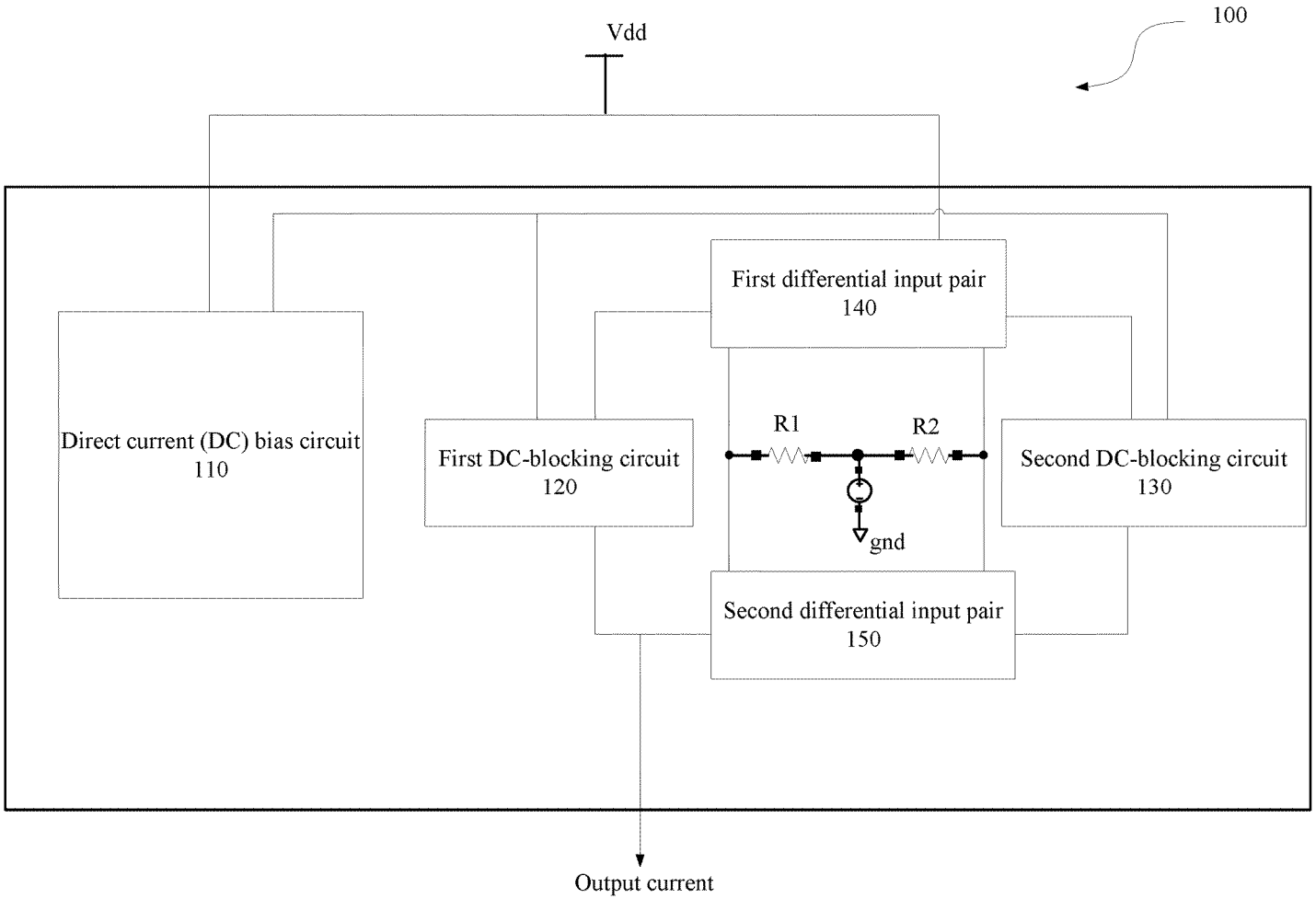
FIG. 1 is a diagram illustrating an embodiment of a voltage-to-current converting circuit.

FIG. 1 is a diagram illustrating an embodiment of a voltage-to-current converting circuit 100. The voltage-to-current converting circuit 100 comprises a direct current (DC) bias circuit 110, a first DC-blocking circuit 120, a second DC-blocking circuit 130, a first differential input pair 140 and a second differential input pair 150. In the embodiment, the DC bias circuit 110 is connected to the first and second DC-blocking circuits 120, 130 and configured to provide a bias voltage to the first and the second differential input pairs 140, 150. In the embodiment, the DC bias circuit 110 comprises a NMOS transistor and a PMOS transistor. A first node of the NMOS transistor is connected to a power supply (Vdd shown in FIG. 1), a second node of the NMOS transistor is connected to the first and second DC-blocking circuits 120, 130 and a second node of the NMOS transistor is connected to a second node of the PMOS transistor. A third node of the PMOS transistor is also connected to the first and second DC-blocking circuits 120, 130 and a first node of the PMOS transistor is connected to ground. Wherein the first node of each of the transistors is a drain, the second node of each of the transistors is a source, and the third node of each of the transistors is a gate. The first DC-blocking circuit 120 is connected between the DC bias circuit 110 and the first and second differential input pairs 140, 150 and configured to block direct current from the DC bias circuit, and the second DC-blocking circuit is connected between the DC bias circuit 110 and the first and second differential input pairs 140, 150 and configured to block direct current from the DC bias circuit 110. In the embodiment, both the first and second differential input pairs 140, 150 comprises a NMOS transistor and a PMOS transistor. The NMOS transistor and the PMOS transistor are connected to each other and the NMOS transistor and the PMOS transistor in the first differential circuit 140 are connected to the NMOS transistor and the PMOS transistor in the second differential circuit 150 via two resistors R1, R2.

In the embodiment, during operation, since the ratio among NMOS transistors in the first differential input pair 140 and the DC bias circuit 110 is equal to the ratio among PMOS transistors in the second differential input pair 150 and the DC bias circuit 110, the DC voltage of the first and second DC-blocking circuits 120, 130 are respectively equal to the DC voltage from the DC bias circuit 110, i.e., Vdd/2. The AC voltage of the first DC-blocking circuits 120 is approximately equal to the AV voltage on the gate of one NMOS transistor in the first differential input pairs 140 and the AV voltage on the gate of one PMOS transistor in the second differential input pair 150 and this AC voltage is the positive input Vinp. And the AC voltage of the second DC-blocking circuit 130 is approximately equal to the AV voltage on the gate of the other NMOS transistor in the first differential input pairs 140 and the AV voltage on the gate of the other PMOS transistor in the second differential input pair 150, and this AC voltage is the negative input Vinn. Thus the AC current passing through one of the two resistors is Vinp/R1 and the AC current passing through the other resistor is Vinn/R2, wherein the resistance value of R1 is equal to the resistance value of R2 and the Vinn is equal to Vinp. The input dynamic range of the voltage-to-current converting circuit 100 can nearly be gnd−Vthp~Vdd+Vthn, wherein the Vthp is a threshold voltage of the PMOS transistor, the Vthn is as threshold voltage of the NMOS transistor, and the DC voltage Vdd can take a small value, and wherein Vdd>Vthp+Vthn. The input dynamic range is large and thus the DC voltage can be small, which can decrease the DC power consumption and the voltage-to-current converting circuit 100 does not use larger components, such as inductors, and thus can reduces the product costs.

Figure 2:
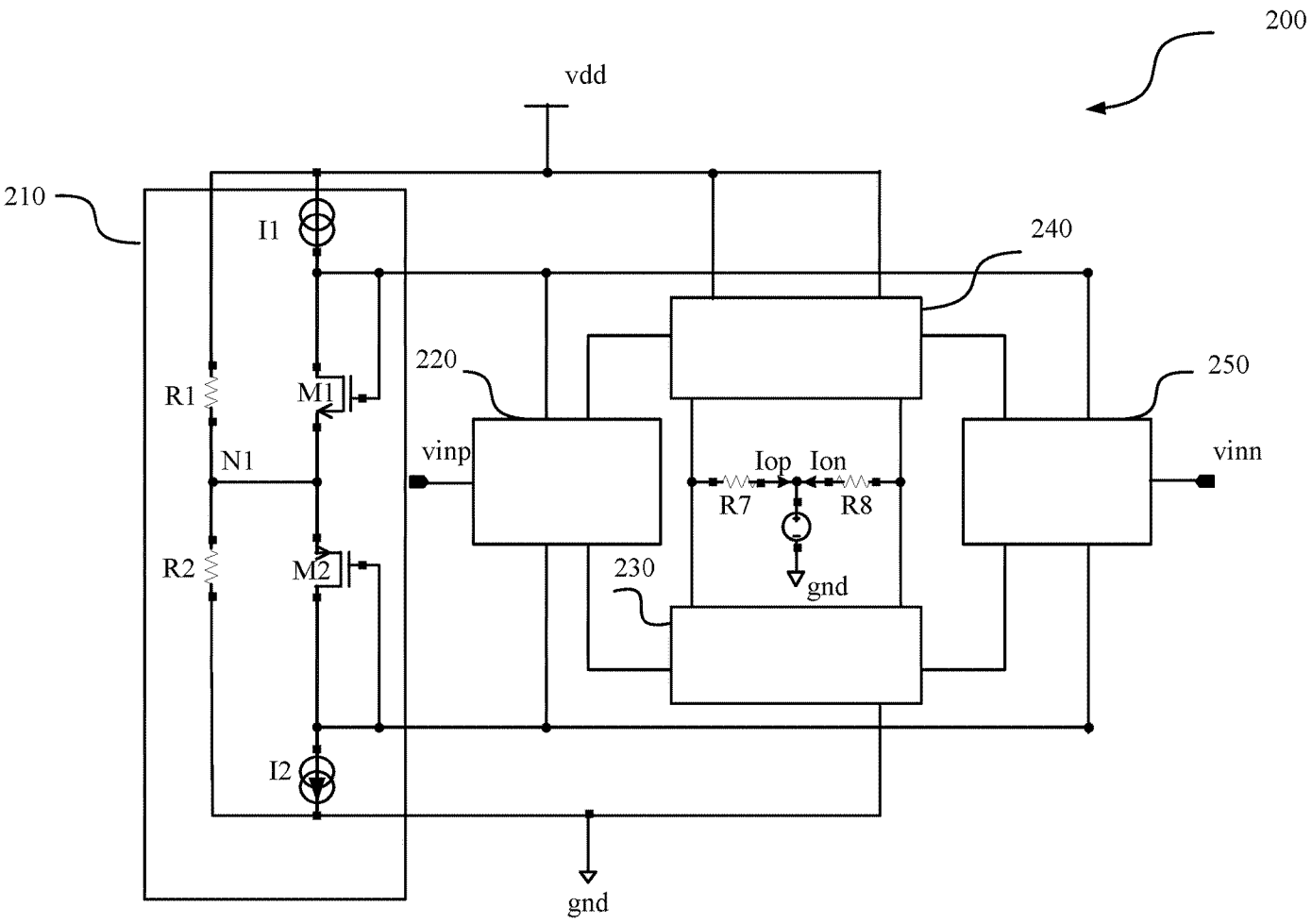
FIG. 2 is a diagram illustrating another embodiment of a voltage-to-current converting circuit.

FIG. 2 is a diagram illustrating another embodiment of a voltage-to-current converting circuit. The voltage-to-current converting circuit 200 also comprises a direct current (DC) bias circuit 210, a first DC-blocking circuit 220, a second DC-blocking circuit 250, a first differential input pair 240 and a second differential input pair 230. In the embodiment, both the first and second differential input pairs 240, 230 comprises a NMOS transistor and a PMOS transistor. The NMOS transistor and the PMOS transistor are connected to each other, and the NMOS transistor and the PMOS transistor in the first differential circuit 240 is connected to the NMOS transistor and the PMOS transistor in the second differential circuit 230 via two resistors R7, R8. To be more specific, the DC bias circuit 210 comprises a first resistor R1, a second resistor R2, a first MOS transistor M1, a second MOS transistor M2, a first current source I1 and a second current source I2.

In the embodiment, a first node of the first resistor R1 is connected to a first node of the first MOS transistor M1, and a first node of the second resistor R2 is connected to a first node of the second MOS transistor M2, and any two of a second node of the first MOS transistor M1, a second node of the second MOS transistor M2, a second node of the first resistor R1 and a second node of the second resistor R2 are connected. The first current source I1 is connected between the first node of the first resistor R1 and the first node of the first MOS transistor M1; and the second current source I2 is connected between the first node of the second resistor R2 and the first node of the second MOS transistor M2.

Still in the embodiment, the second node of the first current source I1, and the first and third nodes of the first MOS transistor M1 are connected to the first and the second DC-blocking circuits 220, 250, and the second node of the second current source I2, and the first and third nodes of the second MOS transistor M2 are also connected to the first and the second DC-blocking circuits 220, 250. Then the first and the second DC-blocking circuits 220, 250 are respectively connected to the first and second differential input pairs 240, 230. The first differential input pair 240 is connected to the second differential input pair 230 via a seventh resistor R7 and an eighth resistor R8, wherein both first nodes of the first and second differential input pairs 240, 230 are connected to ground via a voltage source. Wherein, a first node of the first current source I1 is connected to the first node of the first resistor R1 and a power supply, and a second node of the first current source I1 is connected to the first node of the first MOS transistor M1 and a third node of the first MOS transistor M1, and a first node of the second current source I2 is connected to the first node of the second resistor R2 and ground, and a second node of the second current source I2 is connected to the first node of the second MOS transistor M2 and a third node of the second MOS transistor M2.

Wherein the first MOS transistor M1 is a NMOS transistor and the second MOS transistor M2 is a PMOS transistor, and both M1 and M2 adopt a diode connection, that is, a drain and a gate of M1 and M2 are short circuited. The first node of each of the transistors is a drain, the second node of each of the transistors is a source, and the third node of each of the transistors is a gate. The power supply comprises a positive power source Vdd, and the resistance value of R1 is equal to the resistance value of R2. Thus, the voltage value on a point N1 is Vdd/2.

In the embodiment, during operation, since the ratio among NMOS transistors in the first differential input pair 240 and the NMOS transistor M1 in the DC bias circuit 210 is equal to the ratio among PMOS transistors in the second differential input pair 230 and the PMOS transistor M2 in the DC bias circuit 210, the DC voltage of the first and second DC-blocking circuits 220, 250 are respectively equal to the DC voltage on the point N1, i.e., Vdd/2. The AC voltage of the first DC-blocking circuits 220 is approximately equal to the AV voltage on the gate of one NMOS transistor in the first differential input pairs 240 and the AV voltage on the gate of one PMOS transistor in the second differential input pair 230 and this AC voltage is the positive input Vinp. And the AC voltage of the second DC-blocking circuit 250 is approximately equal to the AV voltage on the gate of the other NMOS transistor in the first differential input pairs 240 and the AV voltage on the gate of the other PMOS transistor in the second differential input pair 230, and this AC voltage is the negative input Vinn. Thus the AC current passing through one of the two resistors is Vinp/R7 and the AC current passing through the other resistor is Vinn/R8, wherein the resistance value of R7 is equal to the resistance value of R8 and the Vinn is equal to Vinp. The input dynamic range of the voltage-to-current converting circuit 200 can nearly be gnd−Vthp~Vdd+Vthn, wherein the Vthp is a threshold voltage of the PMOS transistor, the Vthn is as threshold voltage of the NMOS transistor, and the DC voltage Vdd can take a small value, and wherein Vdd>Vthp+Vthn. The input dynamic range is large and thus the DC voltage can be small, which can decrease the DC power consumption and the voltage-to-current converting circuit 200 does not use larger components, such as inductors, and thus can reduces the product costs.

Figure 3:
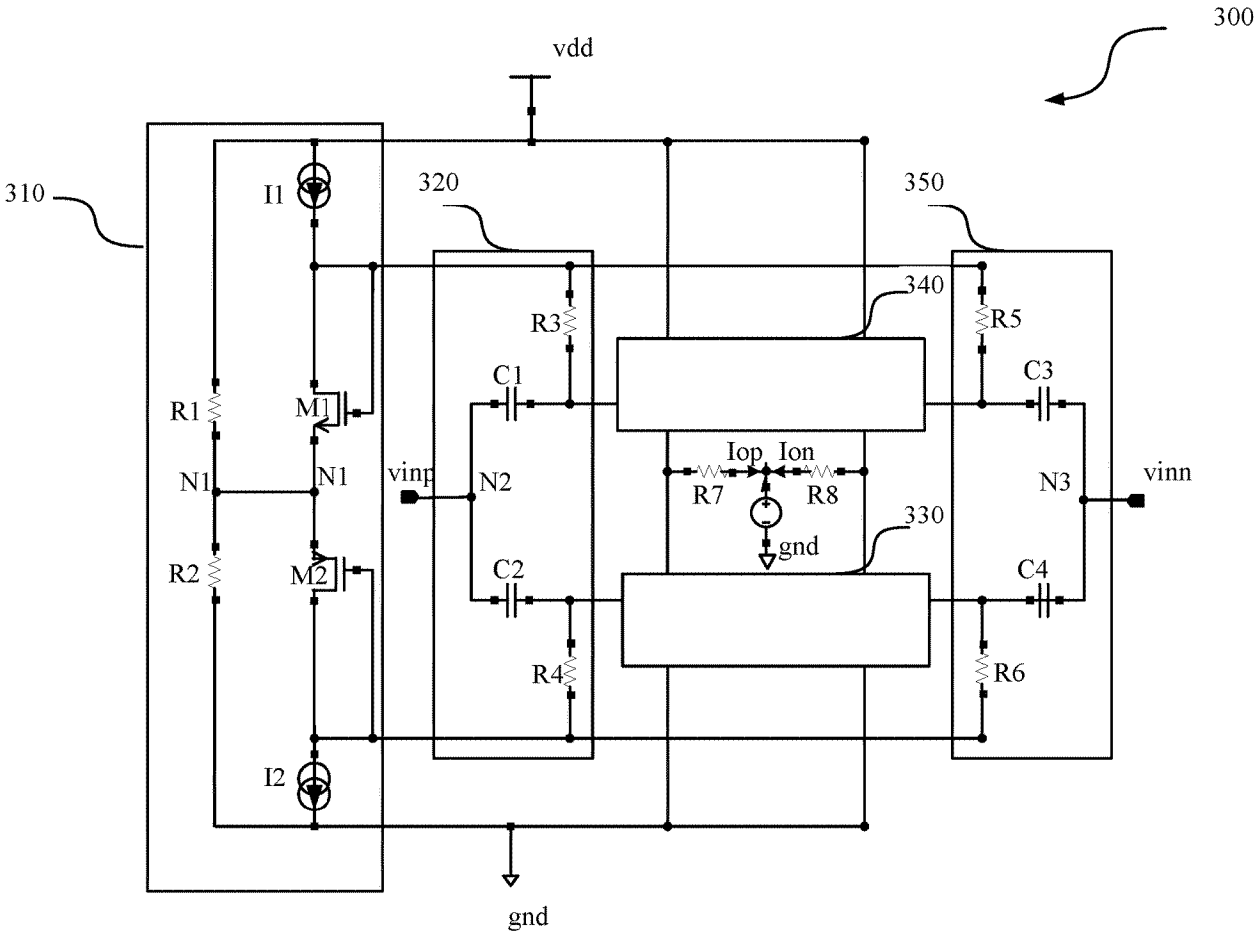
FIG. 3 is a diagram illustrating a specific implementation of the voltage-to-current converting circuit shown in FIG. 2.

FIG. 3 is a diagram illustrating a specific implementation of the voltage-to-current converting circuit 300 in FIG. 2. The voltage-to-current converting circuit 300 also comprises a direct current (DC) bias circuit 310, a first DC-blocking circuit 320, a second DC-blocking circuit 350, a first differential input pair 340 and a second differential input pair 330. In the embodiment, both the first and second differential input pairs 340, 330 comprises a NMOS transistor and a PMOS transistor. The NMOS transistor and the PMOS transistor are connected to each other, and the NMOS transistor and the PMOS transistor in the first differential circuit 340 is connected to the NMOS transistor and the PMOS transistor in the second differential circuit 330 via two resistors R7, R8. In the embodiment, the DC bias circuit 310 comprises a first resistor R1, a second resistor R2, a first MOS transistor M1, a second MOS transistor M2, a first current source I1 and a second current source I2. The connection relationship among these above elements are similar to that of FIG. 2, and details are omitted for elements already described with respect to FIG. 2.

As shown in FIG. 3, a first DC-blocking circuit 320 comprises a first capacitor C1, a second capacitor C2, a third resistor R3 and a fourth resistor R4 and a second DC-blocking circuit 350 comprises a third capacitor C3, a fourth capacitor C4, a fifth resistor R5 and a sixth resistor R6. In the embodiment, a first node of the first capacitor C1 and a first node of the second capacitor C2 are connected and also configured to receive a positive input Vinp; a second node of the first capacitor C1 is connected to a second node of the third resistor R3; a second node of the second capacitor C2 is connected to a second node of the fourth resistor R4; and any two of a first node of the third resistor R3, the first node of the first MOS transistor M1, the third node of the first MOS transistor M1 and the second node of the first current source I1 are connected, and any two of a first node of the fourth resistor R4, the first node of the second MOS transistor M2, the third node of the second MOS transistor M2 and the second node of the second current source I2 are connected.

Still in the embodiment, a first node of the third capacitor C3 and a first node of the fourth capacitor C4 are connected and also configured to receive a negative input Vinn; a second node of the third capacitor C3 is connected to a second node of the fifth resistor R5; a second node of the fourth capacitor C4 is connected to a second node of the sixth resistor R6; and any two of a first node of the fifth resistor R5, the first node of the third resistor R3, the first node of the first MOS transistor M1, the third node of the first MOS transistor M1 and the second node of the first current source I1 are connected, and any two of a first node of the sixth resistor R6, the first node of the fourth resistor R4, the first node of the second MOS transistor M2, the third node of the second MOS transistor M2 and the second node of the second current source I2 are connected. Wherein both the second nodes of the first capacitor C1 and the third resistor R3 are connected to the first differential circuit 340 and both second nodes of the second capacitor C2 and the fourth resistor R4 are connected to the second differential circuit 330; and wherein both the second nodes of the second capacitor C3 and the fifth resistor R5 are also connected to the first differential circuit 340 and both second nodes of the fourth capacitor C4 and the sixth resistor R6 are also connected to the second differential circuit 330. The first differential input pair 340 and the second differential input pair 330 are connected via a seventh resistor R7 and an eighth resistor R8, wherein both first nodes of the first and second differential input pairs 240, 230 are connected to ground via a voltage source.

In the embodiment, during operation, since the ratio among NMOS transistors in the first differential input pair 340 and the NMOS transistor M1 in the DC bias circuit 310 is equal to the ratio among PMOS transistors in the second differential input pair 330 and the PMOS transistor M2 in the DC bias circuit 310, the DC voltage of the first and second DC-blocking circuits 320, 350 are respectively equal to the DC voltage on the point N1, i.e., Vdd/2. The AC voltage on the point N2 is approximately equal to the AV voltage on the gate of one NMOS transistor in the first differential input pairs 340 and the AV voltage on the gate of one PMOS transistor in the second differential input pair 330. And the AC voltage on the point N3 is approximately equal to the AV voltage on the gate of the other NMOS transistor in the first differential input pairs 340 and the AV voltage on the gate of the other PMOS transistor in the second differential input pair 330, and this AC voltage is the negative input Vinn. Thus the AC current passing through the seventh resistor R7 is Vinp/R7 and the AC current passing through the eighth resistor is Vinn/R8, wherein the resistance value of R1 is equal to the resistance value of R2 and the Vinn is equal to Vinp. The input dynamic range of the voltage-to-current converting circuit 400 can nearly be gnd−Vthp~Vdd+Vthn, wherein the Vthp is a threshold voltage of the PMOS transistor, the Vthn is as threshold voltage of the NMOS transistor, and the DC voltage Vdd can take a small value, and wherein Vdd>Vthp+Vthn. The input dynamic range is large and thus the DC voltage can be small, which can decrease the DC power consumption and the voltage-to-current converting circuit 100 does not use larger components, such as inductors, and thus can reduces the product costs.

Figure 4:
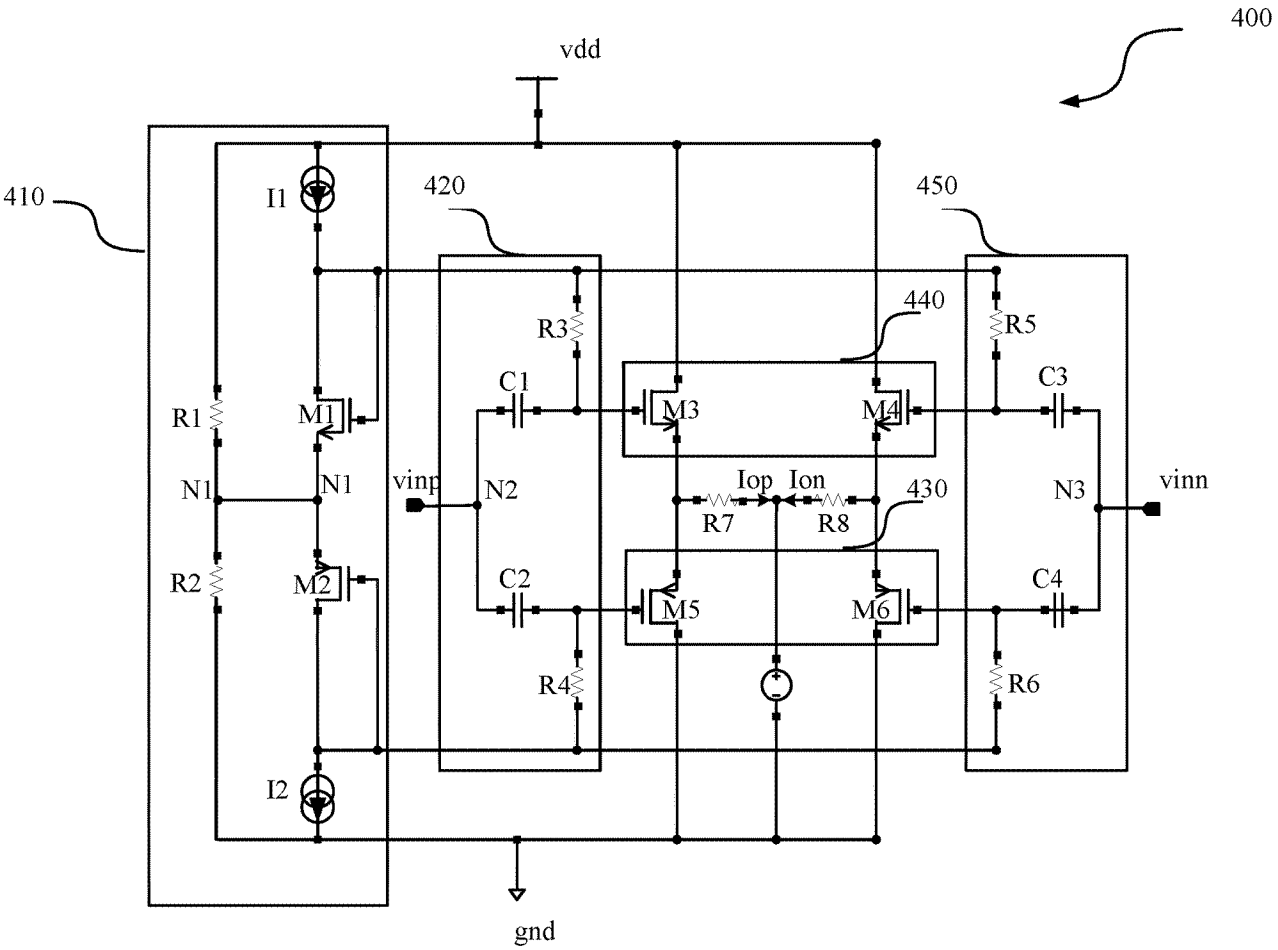
FIG. 4 is a diagram illustrating a further specific implementation of the voltage-to-current converting circuit shown in FIG. 2.

FIG. 4 is a diagram illustrating a further specific implementation of the voltage-to-current converting circuit 400 shown in FIG. 2. In the embodiment, a DC bias circuit 410 and a first and second DC-blocking circuits 420, 450 comprise same elements as the elements described in the DC bias circuit 310 and the first and second DC-blocking circuits 320, 350, and the connection relationships among these elements are similar to that of FIG. 3, and details are omitted for elements already described with respect to FIG. 3.

As shown in FIG. 4, a first differential input pair 440 comprises a third MOS transistor M3 and a fourth MOS transistor M4 and a second differential input pair 430 comprises a fifth MOS transistor M5 and a sixth MOS transistor M6. In the embodiment, any two of a first node of the fifth MOS transistor M5, the first node of the second current source I2, the first node of the second resistor R2 are connected and connected to ground, and a third node of the fifth MOS transistor M5 is connected to both second nodes of the fourth resistor R4 and the second capacitor C2, and any two of a first node of the sixth MOS transistor M6, the first node of the fifth MOS transistor M5, the first node of the second current source I2, the first node of the second resistor R2 are connected and connected to ground, and a third node of the sixth MOS transistor M6 is connected to both second nodes of the sixth resistor R6 and the fourth capacitor C4.

Still in the embodiment, a first node of the seventh resistor R7 is connected to a first node of the eighth resistor R8 and a second node of the seventh resistor R7 is connected to both second nodes of the third MOS transistor M3 and the fifth MOS transistor M5, and a second node of the eighth resistor R8 is connected to both second nodes of the fourth MOS transistor M4 and the sixth MOS transistor M6. Wherein both first nodes of the seventh resistor R7 and eighth resistor R8 are connected to a first node of a voltage source and any two of a second node of the voltage source, the first node of the sixth MOS transistor M6, the first node of the fifth MOS transistor M6, the first node of the second current source I2, the first node of the second resistor R2 are connected and connected to ground.

Wherein the third and the fourth MOS transistors M3, M4 are NMOS transistors, and the fifth and the sixth MOS transistors M5, M6 are PMOS transistors. The first node of each of the transistors is a drain, the second node of each of the transistors is a source, and the third node of each of the transistors is a gate. The voltage source comprises ground (gnd).

Referring to FIG. 4, during operation, since the ratio among the third MOS transistor M3, the fourth MOS transistors M4 and the first MOS transistor M1 is equal to the ratio among the fifth MOS transistors M5, the sixth MOS transistors M6 and the second MOS transistors M2, the DC voltage on point N2 and N3 are respectively equal to the DC voltage on the point N1, i.e., Vdd/2. The AC voltage on the point N2 is approximately equal to the AV voltage on the gate of the third MOS transistor M3 and the AV voltage on the gate of the fifth MOS transistor M5, and this AC voltage is the positive input Vinp. And the AC voltage on the point N3 is approximately equal to the AV voltage on the gate of the fourth MOS transistor M4 and the AV voltage on the gate of the sixth MOS transistor M6, and this AC voltage is the negative input Vinn. Thus the AC current passing through the seventh resistor R7 is Vinp/R7 and the AC current passing through the eighth resistor is Vinn/R8, wherein the resistance value of R7 is equal to the resistance value of R8 and the Vinn is equal to Vinp. The input dynamic range of the voltage-to-current converting circuit 400 can nearly be gnd−Vthp~Vdd+Vthn, wherein the Vthp is a threshold voltage of the PMOS transistor, the Vthn is as threshold voltage of the NMOS transistor, and the DC voltage Vdd can take a small value, and wherein Vdd>Vthp+Vthn. The input dynamic range is large and thus the DC voltage can be small, which can decrease the DC power consumption and the voltage-to-current converting circuit 100 does not use larger components, such as inductors, and thus can reduces the product costs.

Figure 5:
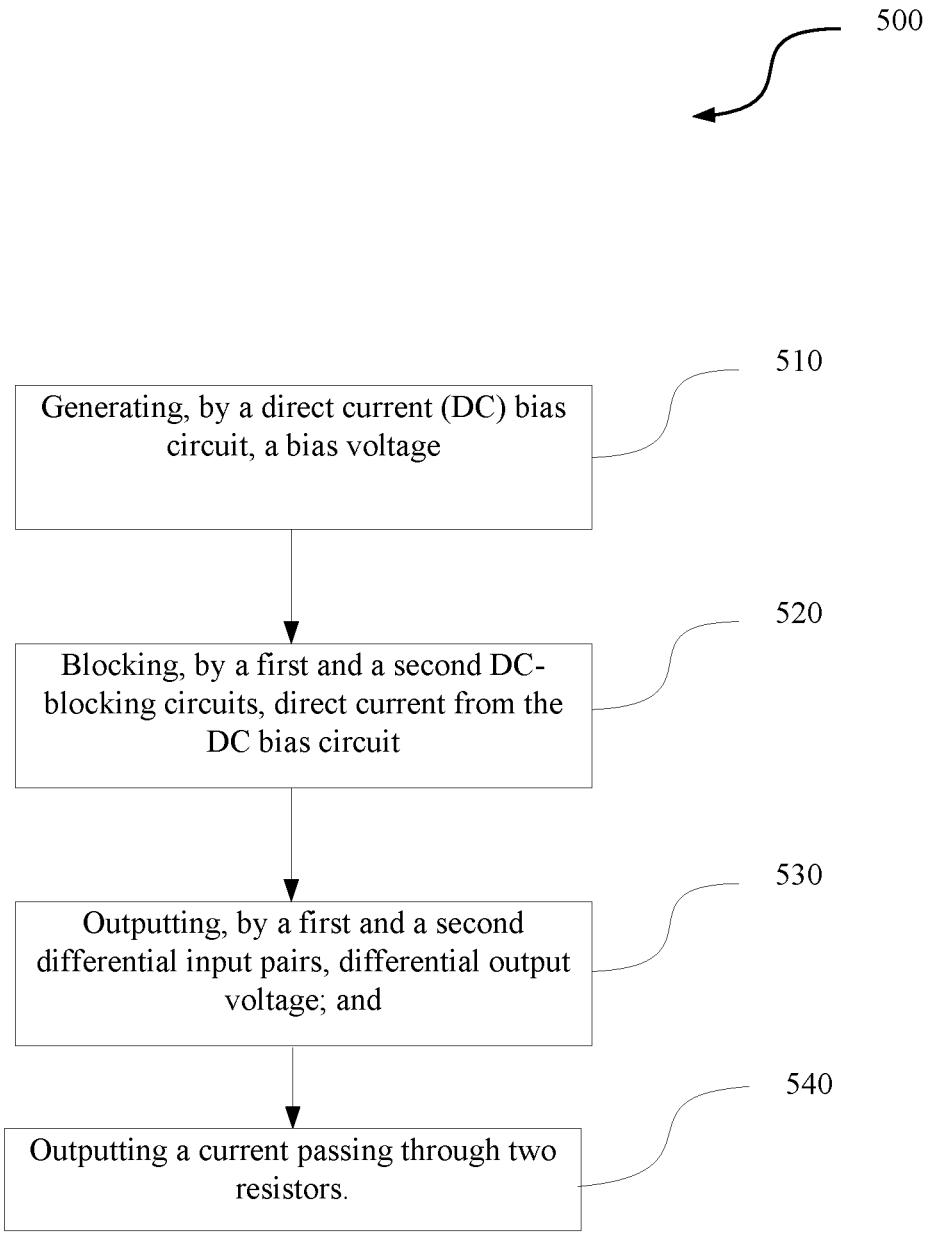
FIG. 5 is a flow chart of a method for converting voltage to current by a voltage-to-current converting circuit.

FIG. 5 is a flow chart of a method 500 for converting voltage to current. The method 500 performed by a voltage-to current converting circuit, for example, the voltage-to-current converting circuit 400 shown in Fig. 4, comprises generating (in block 510), by the DC bias circuit, a bias voltage; blocking (in block 520), by the first and the second DC-blocking circuits, direct current from the DC bias circuit; outputting (in block 530), by the first and the second differential input pairs, differential output voltage; and outputting (in block 540) a current passing through two resistors.

In an embodiment, during implementing the method 500, since the ratio among the third MOS transistor M3, the fourth MOS transistors M4 and the first MOS transistor M1 is equal to the ratio among the fifth MOS transistors M5, the sixth MOS transistors M6 and the second MOS transistors M2, the DC voltage on point N2 and N3 are respectively equal to the DC voltage on the point N1, i.e., Vdd/2. The AC voltage on the point N2 is approximately equal to the AV voltage on the gate of the third MOS transistor M3 and the AV voltage on the gate of the second MOS transistor M5, and this AC voltage is the positive input Vinp. And the AC voltage on the point N3 is approximately equal to the AV voltage on the gate of the fourth MOS transistor M4 and the AV voltage on the gate of the sixth MOS transistor M6, and this AC voltage is the negative input Vinn. Thus the AC current passing through the seventh resistor R7 is Vinp/R7 and the AC current passing through the eighth resistor is Vinn/R8, wherein the resistance value of R7 is equal to the resistance value of R8 and the Vinn is equal to Vinp. The input dynamic range of the voltage-to-current converting circuit 400 can nearly be gnd−Vthp~Vdd+Vthp, wherein the Vthp is a threshold voltage of the PMOS transistor, the Vthn is as threshold voltage of the NMOS transistor, and the DC voltage Vdd can take a small value, and wherein Vdd>Vthp+Vthn. The input dynamic range is large and thus the DC voltage can be small, which can decrease the DC power consumption and the voltage-to-current converting circuit 100 does not use larger components, such as inductors, and thus can reduces the product costs.

It should be appreciated by those ordinary skill in the art that components from different embodiments may be combined to yield another technical solution. This written description uses examples to disclose the invention, including the best mode, and also to enable any person ordinary skill in the art to practice the invention, including making and using any devices or systems and performing any incorporated methods. The patentable scope of the invention is defined by the claims, and may include other examples that occur to those ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A voltage-to-current converting circuit, comprising:

a direct current (DC) bias circuit, a first DC-blocking circuit, a second DC-blocking circuit, a first differential input pair and a second differential input pair, wherein the DC bias circuit comprises a first resistor, a second resistor, a first MOS transistor and a second MOS transistor, a first node of the first resistor is connected to a first node of the first MOS transistor, and a first node of the second resistor is connected to a first node of the second MOS transistor, and wherein resistance of the first resistor is equal to resistance of the second resistor, and any two of a second node of the first MOS transistor, a second node of the second MOS transistor, a second node of the first resistor and a second node of the second resistor are connected, and wherein the DC bias circuit further comprises a first current source and a second current source, the first current source is connected between the first node of the first resistor and the first node of the first MOS transistor, wherein a first node of the first current source is connected to the first node of the first resistor and a power supply, and a second node of the first current source is connected to the first node of the first MOS transistor and a third node of the first MOS transistor, and the second current source is connected between the first node of the second resistor and the first node of the second MOS transistor, wherein a first node of the second current source is connected to the first node of the second resistor and ground, and a second node of the second current source is connected to the first node of the second MOS transistor and a third node of the second MOS transistor;

wherein the DC bias circuit is connected to the first and second DC-blocking circuits and configured to provide a bias voltage to the first and the second differential input pairs;

wherein the first DC-blocking circuit is connected between the DC bias circuit and the first and second differential input pairs and the second DC-blocking circuit is connected between the DC bias circuit and the first and second differential input pairs; and wherein the first differential circuit is connected to the second differential circuit via two resistors.

2. The voltage-to-current converting circuit of claim 1, wherein the first DC-blocking circuit comprises a first capacitor, a second capacitor, a third resistor and a fourth resistor;

wherein a first node of the first capacitor and a first node of the second capacitor are connected and also configured to receive a positive input; a second node of the first capacitor is connected to a second node of the third resistor; a second node of the second capacitor is connected to a second node of the fourth resistor; and wherein any two of a first node of the third resistor, the first node of the first MOS transistor, the third node of the first MOS transistor and the second node of the first current source are connected, and any two of a first node of the fourth resistor, the first node of the second MOS transistor, the third node of the second MOS transistor and the second node of the second current source are connected.

3. The voltage-to-current converting circuit of claim 2, wherein the second DC-blocking circuit comprises a third capacitor, a fourth capacitor, a fifth resistor and a sixth resistor;

wherein a first node of the third capacitor and a first node of the fourth capacitor are connected and also configured to receive a negative input; a second node of the third capacitor is connected to a second node of the fifth resistor; a second node of the fourth capacitor is connected to a second node of the sixth resistor; and wherein any two of a first node of the fifth resistor, the first node of the third resistor, the first node of the first MOS transistor, the third node of the first MOS transistor and the second node of the first current source are connected, and any two of a first node of the sixth resistor, the first node of the fourth resistor, the first node of the second MOS transistor, the third node of the second MOS transistor and the second node of the second current source are connected.

4. The voltage-to-current converting circuit of claim 3, wherein the first differential input pair comprises a third MOS transistor and a fourth MOS transistor;

wherein any two of a first node of the third MOS transistor, the first node of the first current source, the first node of the first resistor and the power supply are connected, and a third node of the third MOS transistor is connected to both second nodes of the third resistor and the first capacitor; and wherein any two of a first node of the fourth MOS transistor, the first node of the third MOS transistor, the first node of the first current source, the first node of the first resistor and the power supply are connected, and a third node of the fourth MOS transistor is connected to both second nodes of the fifth resistor and the third capacitor.

5. The voltage-to-current converting circuit of claim 4, wherein the second differential input pair comprises a fifth MOS transistor and a sixth MOS transistor;

wherein any two of a first node of the fifth MOS transistor, the first node of the second current source, the first node of the second resistor are connected and connected to ground, and a third node of the fifth MOS transistor is connected to both second nodes of the fourth resistor and the second capacitor; and wherein any two of a first node of the sixth MOS transistor, the first node of the fifth MOS transistor, the first node of the second current source, the first node of the second resistor are connected and connected to ground, and a third node of the sixth MOS transistor is connected to both second nodes of the sixth resistor and the fourth capacitor.

6. The voltage-to-current converting circuit of claim 5, wherein the first differential input pair is connected to the second differential input pair via a seventh resistor and an eighth resistor;

wherein a first node of the seventh resistor is connected to a first node of the eighth resistor and a second node of the seventh resistor is connected to both second nodes of the third MOS transistor and the fifth MOS transistor;

wherein a second node of the eighth resistor is connected to both second nodes of the fourth MOS transistor and the sixth MOS transistor; and wherein both first nodes of the seventh resistor and eighth resistor are connected to a first node of a voltage source and any two of a second node of the voltage source, the first node of the sixth MOS transistor, the first node of the fifth MOS transistor, the first node of the second current source, the first node of the second resistor are connected and connected to ground.

7. The voltage-to-current converting circuit of claim 6, wherein the first, the third and the fourth MOS transistors are NMOS transistors, the second, the fifth and the sixth MOS transistors are PMOS transistors; and the first node of each of the transistors is a drain, the second node of each of the transistors is a source, and the third node of each of the transistors is a gate.

8. A method for converting voltage to current by a voltage-to-current converting circuit, wherein the circuit comprises: a direct current (DC) bias circuit, a first DC-blocking circuit, a second DC-blocking circuit, a first differential input pair and a second differential input pair, wherein the DC bias circuit comprises a first resistor, a second resistor, a first MOS transistor and a second MOS transistor, a first node of the first resistor is connected to a first node of the first MOS transistor, and a first node of the second resistor is connected to a first node of the second MOS transistor, and wherein resistance of the first resistor is equal to resistance of the second resistor, and any two of a second node of the first MOS transistor, a second node of the second MOS transistor, a second node of the first resistor and a second node of the second resistor are connected; and wherein the DC bias circuit further comprises a first current source and a second current source, the first current source is connected between the first node of the first resistor and the first node of the first MOS transistor, wherein a first node of the first current source is connected to the first node of the first resistor and a power supply, and a second node of the first current source is connected to the first node of the first MOS transistor and a third node of the first MOS transistor, and the second current source is connected between the first node of the second resistor and the first node of the second MOS transistor, wherein a first node of the second current source is connected to the first node of the second resistor and ground, and a second node of the second current source is connected to the first node of the second MOS transistor and a third node of the second MOS transistor;

wherein the DC bias circuit is connected to the first and second DC-blocking circuits;

wherein the first DC-blocking circuit is connected between the DC bias circuit and the first and second differential input pairs and the second DC-blocking circuit is connected between the DC bias circuit and the first and second differential input pairs; and wherein the first differential circuit is connected to the second differential circuit via two resistors;

the method comprises:

generating, by the DC bias circuit, a bias voltage;

blocking, by the first and second DC-blocking circuits, direct current from the DC bias circuit;

outputting, by the first and second differential input pairs, differential output voltage; and outputting a current passing through the two resistors.

9. The method of claim 8, wherein the first DC-blocking circuit comprises a first capacitor, a second capacitor, a third resistor and a fourth resistor;

wherein a first node of the first capacitor and a first node of the second capacitor are connected and also configured to receive a positive input; a second node of the first capacitor is connected to a second node of the third resistor; a second node of the second capacitor is connected to a second node of the fourth resistor; and wherein any two of a first node of the third resistor, the first node of the first MOS transistor, the third node of the first MOS transistor and the second node of the first current source are connected, and any two of a first node of the fourth resistor, the first node of the second MOS transistor, the third node of the second MOS transistor and the second node of the second current source are connected.

10. The method of claim 9, wherein the second DC-blocking circuit comprises a third capacitor, a fourth capacitor, a fifth resistor and a sixth resistor;

wherein a first node of the third capacitor and a first node of the fourth capacitor are connected and also configured to receive a negative input; a second node of the third capacitor is connected to a second node of the fifth resistor; a second node of the fourth capacitor is connected to a second node of the sixth resistor; and wherein any two of a first node of the fifth resistor, the first node of the third resistor, the first node of the first MOS transistor, the third node of the first MOS transistor and the second node of the first current source are connected, and any two of a first node of the sixth resistor, the first node of the fourth resistor, the first node of the second MOS transistor, the third node of the second MOS transistor and the second node of the second current source are connected.

11. The method of claim 10, wherein the first differential input pair comprises a third MOS transistor and a fourth MOS transistor;

wherein any two of a first node of the third MOS transistor, the first node of the first current source, the first node of the first resistor and the power supply are connected, and a third node of the third MOS transistor is connected to both second nodes of the third resistor and the first capacitor; and wherein any two of a first node of the fourth MOS transistor, the first node of the third MOS transistor, the first node of the first current source, the first node of the first resistor and the power supply are connected, and a third node of the fourth MOS transistor is connected to both second nodes of the fifth resistor and the third capacitor.

12. The method of claim 11, wherein the second differential input pair comprises a fifth MOS transistor and a sixth MOS transistor;

wherein any two of a first node of the fifth MOS transistor, the first node of the second current source, the first node of the second resistor are connected and connected to ground, and a third node of the fifth MOS transistor is connected to both second nodes of the fourth resistor and the second capacitor; and wherein any two of a first node of the sixth MOS transistor, the first node of the fifth MOS transistor, the first node of the second current source, the first node of the second resistor are connected and connected to ground, and a third node of the sixth MOS transistor is connected to both second nodes of both the sixth resistor and the fourth capacitor.

13. The method of claim 12, wherein the first differential input pair is connected to the second differential input pair via a seventh resistor and an eighth resistor;

wherein a first node of the seventh resistor is connected to a first node of the eighth resistor and a second node of the seventh resistor is connected to both second nodes of the third MOS transistor and the fifth MOS transistor;

wherein a second node of the eighth resistor is connected to both second nodes of the fourth MOS transistor and the sixth MOS transistor; and wherein both first nodes of the seventh resistor and eighth resistor are connected to a first node of a voltage source and any two of a second node of the voltage source, the first node of the sixth MOS transistor, the first node of the fifth MOS transistor, the first node of the second current source, the first node of the second resistor are connected and connected to ground.

14. The method of claim 13, wherein the first, the third and the fourth MOS transistors are NMOS transistors, the second, the fifth and the sixth MOS transistors are PMOS transistors; and the first node of each of the transistors is a drain, the second node of each of the transistors is a source, and the third node of each of the transistors is a gate.

* * * * *